US011103758B2

(12) United States Patent
Schmaltz

(10) Patent No.: US 11,103,758 B2
(45) Date of Patent: Aug. 31, 2021

(54) GOLF SWING TRAINING AID

(71) Applicant: Perfect Path Golf Ltd., Saskatoon (CA)

(72) Inventor: Clinton Schmaltz, Saskatoon (CA)

(73) Assignee: Perfect Path Golf Ltd., Saskatoon (CA)

( * ) Notice: Subject to any disclaimer, the term of this patent is extended or adjusted under 35 U.S.C. 154(b) by 0 days.

(21) Appl. No.: 15/931,076

(22) Filed: May 13, 2020

(65) Prior Publication Data

US 2020/0360790 A1 Nov. 19, 2020

(30) Foreign Application Priority Data

May 13, 2019 (CA) ..... 3042897

(51) Int. Cl.
*A63B 69/36* (2006.01)

(52) U.S. Cl.
CPC .... *A63B 69/36211* (2020.08); *A63B 69/3685* (2013.01)

(58) Field of Classification Search
CPC ..... A63B 69/3676; A63B 2071/0694; A63B 69/36211; A63B 69/3685; A63B 2071/024; A63B 69/3623; A63B 2220/18; A63B 69/3621; A63B 69/36; A63B 53/0487
USPC ..... 473/226, 227, 257, 258, 260–265, 328
See application file for complete search history.

(56) References Cited

U.S. PATENT DOCUMENTS

| | | | | | |
|---|---|---|---|---|---|
| 2,084,901 | A * | 6/1937 | Eisenberg | A63B 69/36211 | 473/229 |
| 3,104,108 | A * | 9/1963 | Robertson | A63B 69/3676 | 473/229 |
| 5,152,534 | A * | 10/1992 | Sindelar | A63B 69/3685 | 473/260 |
| 6,458,039 | B1 * | 10/2002 | Fontes | A63B 69/3676 | 473/258 |
| 6,840,870 | B1 * | 1/2005 | Froggatte | A63B 24/0003 | 473/265 |
| 7,666,107 | B2 * | 2/2010 | Sorenson | A63B 69/3676 | 473/256 |
| 2006/0116214 | A1 * | 6/2006 | Tiziani | A63B 69/3667 | 473/257 |
| 2007/0173339 | A1 * | 7/2007 | Rivard | A63B 69/3676 | 473/266 |
| 2012/0100924 | A1 * | 4/2012 | Covino | A63B 69/3676 | 473/257 |

* cited by examiner

*Primary Examiner* — Nini F Legesse
(74) *Attorney, Agent, or Firm* — Myers Bigel, P.A.

(57) ABSTRACT

A training aid for use in developing putting mechanics is disclosed. The aid comprises a base that is placed on a practice putting surface. The base includes a guide rail shaped to describe two superimposed arcs that define the optimal 3-dimensional path for a putting stroke. The training aid includes a practice putter that has a notch in the base of the putter head that fits over the guide rail. The notch causes the putter head follow the path defined by the guide rail. Deviation from the optimal path results in friction between the notch and guide rail, which in turn provides tactile feedback to the user that they are off the optimal path. The device also includes features that allow for optimal placement of the golf ball relative to the intended line of the putt and marking to assist in gauging the distance the golf ball will travel.

10 Claims, 4 Drawing Sheets

GOLF SWING TRAINING AID

CROSS-REFERENCE TO RELATED APPLICATION

This application claims priority to Canadian Patent Application Ser. No. 3,042,897, filed on May 13, 2019, in the Canadian Intellectual Property Office, the disclosure of which is incorporated herein by reference in its entirety.

FIELD OF THE INVENTION

The invention is in the field of sports accessories, in particular training aids for use in improving golfing skills such as putting.

BACKGROUND

There are a multitude of training devices to assist golfers in developing their skill in various aspects of the game. Many of these aids are designed to help golfers improve their swing mechanics. However, from a scoring perspective, the most effective way to improve golf scoring is through mastery of the "short game" and in particular the act of putting. Studies have found that players with handicaps in the 10-19 range average 31 putts per 18 holes, which is about 30-40% of the total number of strokes taken in a round.

A variety of devices have been created to assists players with putting mechanics. These include one disclosed in U.S. Pat. No. 9,636,562 (Way), which discloses a device to limit leg movement during the putting stroke. Other devices include those designed to provide visual feedback to allow a player to improve their skill in aiming putts, such as the one disclosed in U.S. Pat. No. 5,913,732 (Kwakkel). However, there are very few devices that actually assist a player in improving the basic mechanics of the putting stroke. Reproducibility of putter head speed and the angle at which the putter head contacts the golf ball, optimally exactly 90° relative to the intended initial ball path, are critical elements in developing a reproducible and accurate putting stroke.

SUMMARY OF THE INVENTION

The invention comprises a training aid that assists a user in developing putting mechanics that consistently produce an optimal stroke path for putting. The invention comprises a base that is placed on a practice putting surface. The base includes a guide rail, the guide rail shaped to describe two superimposed arcs that together define the optimal 3-dimensional path for a putter head during a putting stroke. The training aid also includes a practice putter, which comprises a putter with a notch in the base of the putter head, the notch designed to fit over the guide rail so that during a practice putting stroke the putter head follows the path defined by the guide rail. Deviation from the optimal path results in increased friction between the notch and guide rail, which in turn provides tactile feedback to the user that they are off the optimal path. The device also includes features that allow for optimal placement of the golf ball relative to the intended line of the putt, as well as markings to allow for gauging the distance the ball will travel when struck by the practice putter in the course of a putting stroke.

Thus, in some embodiments the invention comprises a training aid to assist a user in practicing a putting stroke, the training aid comprising: a base, the base comprising a top surface, bottom surface and edge; a guide rail, the guide rail located on the top surface of the base, wherein the guide rail is shaped to describe two superimposed arcs, a first arc, oriented substantially parallel to a surface on which the training aid is to be used, and a second arc, oriented substantially perpendicular to the putting surface on which the training aid is to be used, and wherein the superimposition of the first and second arcs describes an optimal path for putting a golf ball along an intended initial path towards an intended target; and a practice putter, the practice putter comprising a golf club configured in the shape of a putter, the practice putter comprising a putter head, a shaft, and a handle for grasping by a user, the putter head further comprising a notch, the notch shaped and sized to act cooperatively with the guide rail to guide the putter head along the optimal path for putting in the course of making a practice putting stroke.

In some embodiments, the base further comprises a golf ball placement area, the golf ball placement area configured to aid a user in placing a golf ball, the golf ball having a center of mass, such that the center of mass of the golf ball is positioned substantially directly over the intended initial path.

In some embodiments, the top surface of the training aid further comprises one or more force markings to aid a user in varying the force applied to the golf ball in the course of making the practice putting stroke.

In some embodiments, the training aid further includes a conversion table to allow a user to estimate, with respect to a specific force marking and a stimpmeter reading, the distance a putt will be expected to travel when the putter is released from the specific force marking position.

In some embodiments, the training aid further comprises a plurality of mounting holes, the mounting holes useful in securing the training aid to a location on a surface.

There is also described a method of practicing putting, the method comprising: providing a training aid, the training aid comprising: a base, the base comprising a top surface, bottom surface and edge; a guide rail, the guide rail located on the top surface of the base, wherein the guide rail is shaped to describe two superimposed arcs, a first arc, oriented substantially parallel to a surface on which the training aid is to be used, and a second arc, oriented substantially perpendicular to the surface on which the training aid is to be used, and wherein the superimposition of the first and second arcs describes an optimal path for putting a golf ball along an intended initial path towards an intended target; and a practice putter, the practice putter comprising a golf club configured in the shape of a putter, the practice tool comprising a putter head, a shaft, and a handle for grasping by a user, the putter head further comprising a notch, the notch shaped and sized to cooperate with the guide rail to guide the putter head along the optimal path for putting in the course of making a practice putting stroke; placing a golf ball at a location on the putting surface substantially in line with the intended initial path; placing the practice putter such that the notch is placed over the guide rail; while holding the handle of the practice putter, drawing the practice putter away from the intended target and the golf ball to a point such that a desired amount of kinetic energy is stored in the putter head; allowing the practice putter, under the influence of gravity, to swing back towards the golf ball and allowing the putter to strike the golf ball, sending the golf ball along the intended initial path towards the target.

In some embodiments of the method, the base further comprises a golf ball placement area, the golf ball placement area configured to aid a user in placing a golf ball, the golf ball having a center of mass, such that the center of mass of the golf ball is positioned substantially directly over the intended initial path, and positioning the golf ball in the golf ball placement area.

In some embodiments of the method, the top surface of the training aid further comprises one or more markings to aid a user in varying the force applied to the golf ball in the course of making the practice putting stroke, and the user refers to the one or more markings to adjust the distance the golf ball will travel when making the practice putting stroke.

In some embodiments, the method further comprises referring to a conversion table to estimate, with respect to a specific force marking and a stimpmeter reading, the distance a putt will be expected to travel when the putter is released from the specific force marking position.

In some embodiments of the method, the base further comprises mounting holes, the mounting holes useful in securing the training aid to a location on a surface, and the user secures the training aid to the putting surface by inserting an object through each of the holes effective to engage the training aid and the putting surface such that the training aid is maintained substantially in place when in use.

In some embodiments of the method, the user repeats the steps above as part of a putting practice regime.

BRIEF DESCRIPTION OF THE DRAWINGS

Preferred embodiments of the present invention are described herein, with reference to the accompanying drawings, in which.

DETAILED DESCRIPTION OF THE INVENTION

Figure 1A:
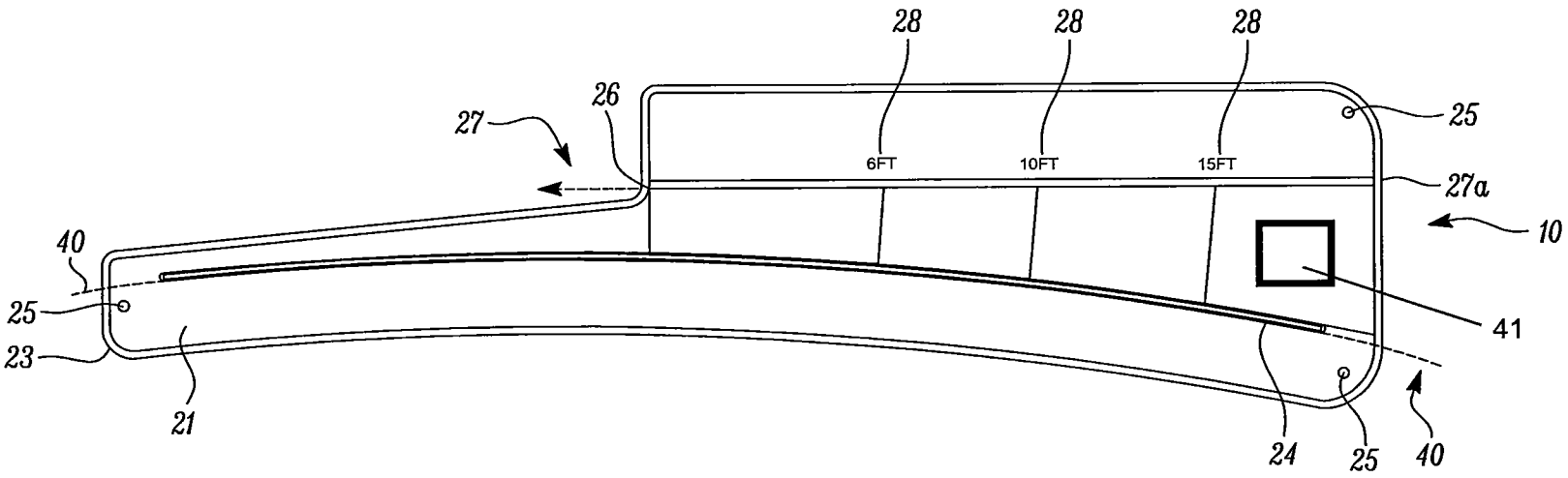
FIG. 1A is a top view of an embodiment of a golf training aid according to the present disclosure.

Embodiments of the present invention provide a training device to assist a user in developing a reproducible and mechanically optimal putting stroke. As is depicted in the FIGS. 1A, 1B, 2A and 2B, an embodiment of a putting training device comprises a base 10, comprising a top surface 21, a bottom surface 22, edge 23 and a curved guide rail 24 that extends upwards at substantially a 90° angle relative to the plane formed by the top surface 21 of the base 10. The shape of the device depicted is one example and the shape can be varied without departing from the essential features of the invention or limiting the scope of the invention as set forth in the accompanying claims.

Figure 4:
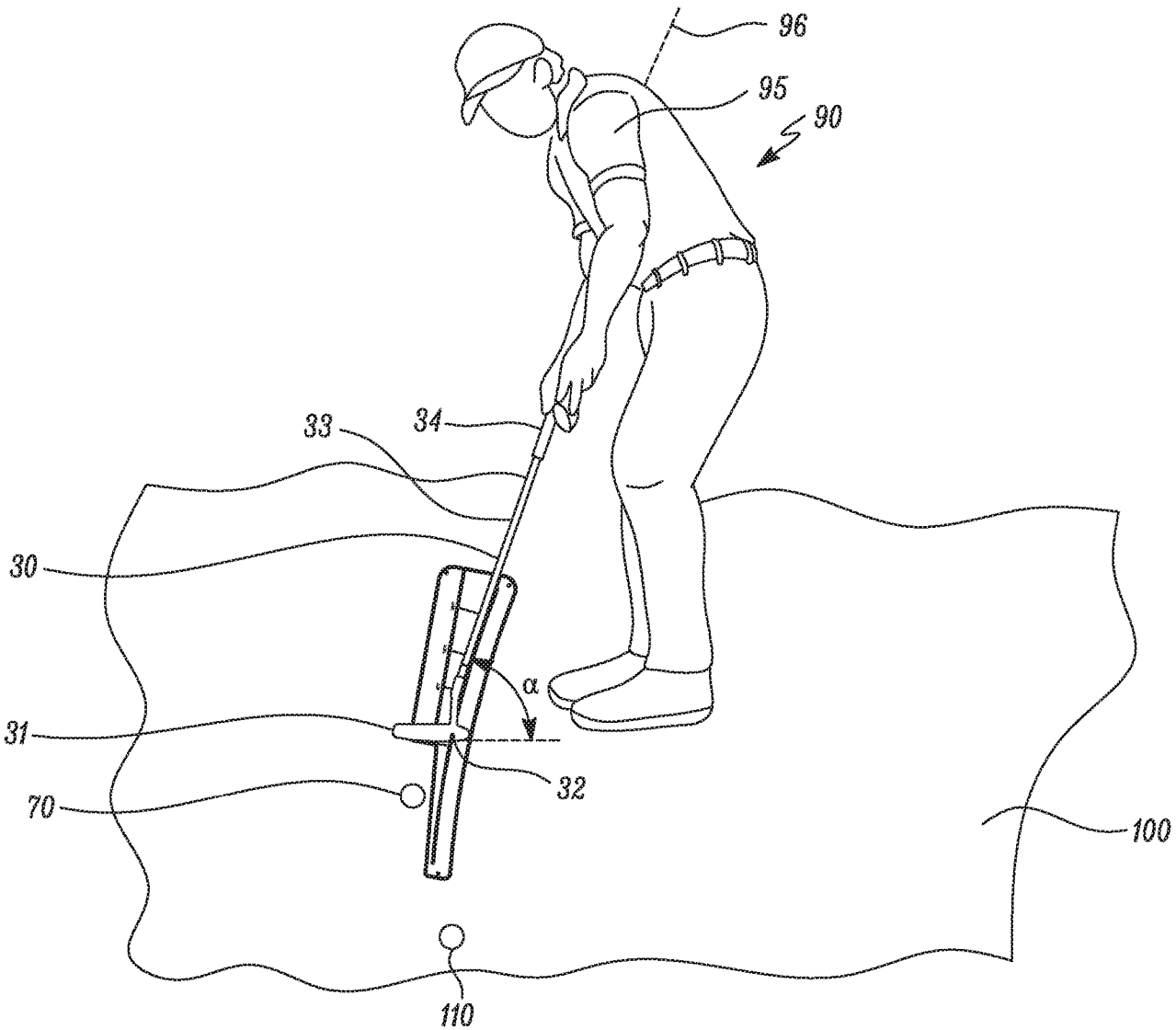
FIG. 4 depicts a golfer using an embodiment of a golf training aid of the present disclosure in a practice regime.

The base 10 is configured to be placed flat on a surface 100, for example on a practice putting green, with the bottom surface 22 in contact with the surface (See FIG. 4). The surface will generally be a practice putting green, or any other suitable surface that the user wishes to place the device for putting practice. The device also include a plurality of holes 25 that allow a user to insert a spike, pin, golf tee or other similar elongated structure, into the surface on which the device is placed for use such that the device and the surface are engaged by the elongate structure such that the training aid is substantially prevented from moving relative to the surface it is placed on while in use. The holes could also be used to admit conventional fasteners such as screws or bolts that would engage complimentary locations and elements in the underlying surface, for example if more permanent mounting were desired.

Figure 3:
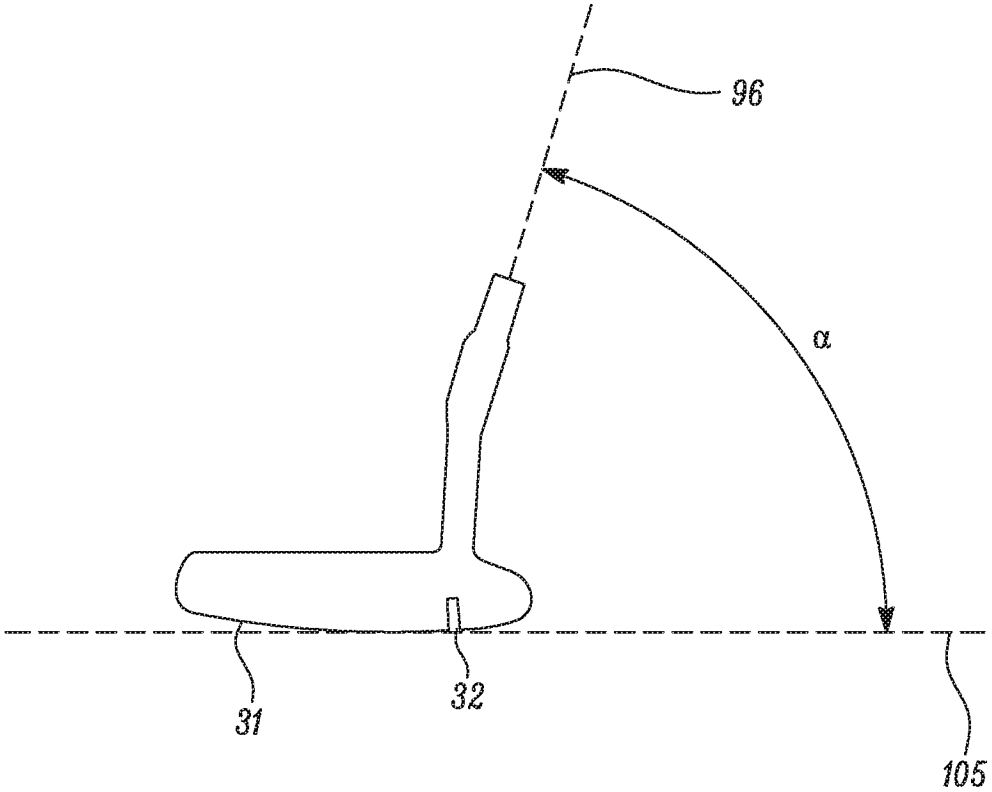
FIG. 3 is a face-on view of an embodiment of a practice putter designed to be used in conjunction with a golf training aid according to the present disclosure.

Embodiments of the training aid also include a practice putter 33, as shown in FIGS. 3 and 4. The practice putter is similar to a conventional putter but here the putter head 31 includes a notch 32 cut into the putter head. The practice putter includes a shaft 30 and grip 34 as in conventional putters. This notch is designed to fit over the guide rail 24, with the notch sized wider than the width of the guide rail such that when the putter is used with the training aid, the rail and groove will cooperatively maintain the putter head along the optimal putting path as defined by the guide rail 24 while still allowing the putter head to be moved with little resistance as long as it follows this optimal path.

FIG. 1A also shows a conversion table 41 which as claimed and outlined elsewhere herein would be a visual indicator that could be used by a golfer practising using the training aid of the present invention to match up particular force markings and corresponding practice putting strokes with particular stimpmeter readings, being the compression or speed of the golf green, to approximate or estimate the likely distance of travel of a golf ball on a particular speed of green with a particular force applied.

If the user follows the optimal path, the notch and guide rail make little contact with each other and the putter head moves freely back and forth and with little resistance felt by the user.

If the user follows the optimal path, the notch and guide rail make little contact with each other and the putter head moves freely back and forth and with little resistance felt by the user. If the user moves the putter in such a way as to depart from this ideal path, the sides of the notch will make contact with the rail, increasing friction and resistance to the movement of the putter head, this providing tactile feedback to the user that the putter head is not following the optimal path. Over time, this feedback will lead to the creation of muscle memory in the user such that the optimal path if followed more precisely more often without the need for conscious effort.

In most instances, a commonly used method of putting is for the golfer to hold the putter with both hands, with arms fully extended. Since a ball being struck by a putter generally behaves in the same manner as an elastic collision, the angle of incidence at the moment of contact will equal the angle at which the ball bounces off the putter face. Thus, the optimal putting stroke is made by the aligning the face of the putter head perpendicular to the intended initial path along which the golf ball is to be struck, the idea that at the point when the putter face contacts the golf ball, the ball is precisely directed along the desired initial path.

Since the arms are generally extended, the arms and putter cooperate to create a pendulum that oscillates back and forth during the putting stroke. Like other pendulums, a putter in the hands of a user behaves like a mass or "bob" located at the end of a "rod." In this instance, the bob of the practice putter is primarily the mass within the putter head 31, and the rod comprises the putter shaft 30 and the arms of the user 90. The putter used in this way behaves as a pendulum having a pivot point 95 that is located along a line 96 that extends between the shoulders of the user. The end of the pendulum opposite will be at a point, roughly coinciding with the center of mass of the putter head. The length of the pendulum (which affects the natural frequency) will be the distance from the hypothetical pivot point to the center of mass of the putter head.

It is also important to understand that in a common putting stroke, the golfer addresses the ball such that the effective pivot point is not directly above the ball but is located above a point over the putting surface that is a distance from the ball depending on the user's putting style and the precise conformation of the putter. Thus, the "pendulum" forms an angle "α" relative to the putting surface 100 that will be less then 90° as measured with respect to a plane 105 formed by the surface on which the training aid is place, as depicted in FIGS. 3 and 4.

As a result, the end of the pendulum, which we can imagine to be reasonably well-represented by the putter head 31, will during a putting stroke generally follow a curved path comprised of two superimposed arcs, which when said putting stroke is made with the assistance of the putting aid will follow the path defined by the shape of the guide rail 24. The shape of the guide rail defines each of these arcs.

Figure 1B:
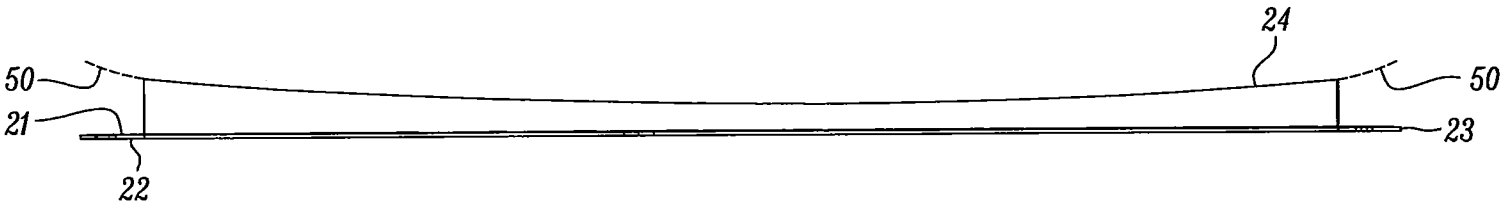
FIG. 1B is a front view of an embodiment of a golf training aid according to the present disclosure.

The first arc 40 will describe a curve oriented in the plane of the practice surface, which is depicted in FIG. 1A. The effective radius of the first arc is defined by the degree of curvature of the guide rail 24. The second arc 50 will be oriented generally perpendicular to the plane of the practice surface, as depicted FIG. 1B. As depicted in FIG. 1B, it will be appreciated that the effective radius of the second arc is defined by varying the height that the guide 24 extends above the top surface 21 of the training aid, and where the guide is tallest at either end of the putting stroke and shortest at the point where the putter head contacts the golf ball. As will be appreciated by those of skill in the art, this takes into account that because the arms and putter behave as a pendulum having a rod of fixed length, the putter head will follow a 3-dimensional path with respect to the putting surface. Thus, the training aid controls the path of the putter head in three dimensions, training a user to develop a putting technique that is optimal for executing an accurate putt, and which provides a precise and reproducible path through which the putter head can be made to travel when making a putting stroke.

A key and unique element of the interaction between the rail and the putter notch is that the putter must stay aligned with the optimal path at all times if the stroke is to be made without causing "binding" or "interruption" to the putting stroke due to friction between the notch and guide rail. This is an important design element because it is imperative that the user maintain this relationship between the face angle and the putter path in order for the putter to travel smoothly down the intended target line. The maintenance of this relationship is meant to provide tactile feedback to the user so that the user can eliminate movements that stray from the optimal putting path as this is a fundamental cause of inaccuracy and inconsistency.

Figure 2A:
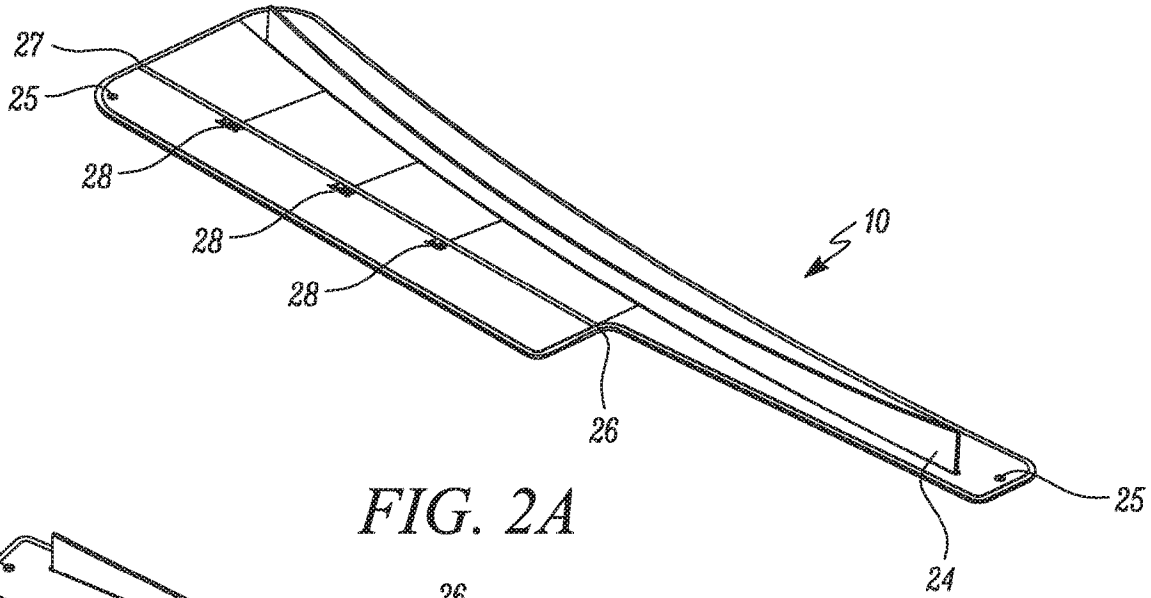
FIG. 2A is a perspective view of an embodiment of a golf training aid according to the present disclosure.
Figure 2B:
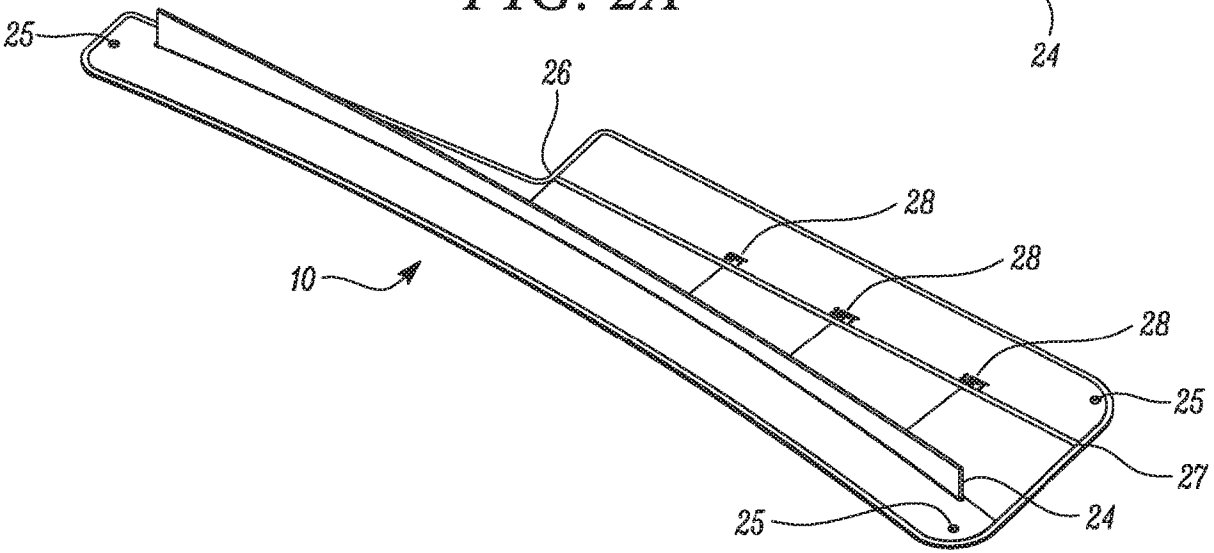
FIG. 2B is a second perspective view of an embodiment of a golf training aid according to the present disclosure.

In some cases, the base can also include various markings and structural features to assist the user in making the desired putting stroke. For example, and as shown in FIGS. 1A, 2A and 2B, the device can include a curved ball placement area 26, to permit consistent placement of the ball to be putted with respect to the desired path 27 the ball is to follow after being struck by the putter, the goal of course is for the ball to wind up at the end target point, which in most cases will be a golf hole 110. The device can include a visual target line reference 27*a*, to further enhance the visualization of the initial path that the ball will follow if struck squarely. The position and sizing of the ball placement area 26 will be such that the center of the golf ball 70 will be substantially aligned with the center of mass of the putter head at the point at which the putter head strikes the ball. Aligning the putter head center of mass with the center of the golf ball is desirable in that it is the most efficient manner in which to predictably maximize transfer of the kinetic energy in the moving putter head to the golf ball. The practice putter is designed such that when it follows the path defined by the guide rail, the center of mass of the putter head will contact the golf at a point in line with the center of mass of the golf ball.

The device can also have additional markings to aid the user in adjusting the force of the putting stroke. As is well known in the physics of pendulums, the speed at which the bob on a pendulum is moving when it reaches the bottom point of its swing path is dictated by the degree that the mass of the pendulum has been moved from that lowest point minimal energy position. When applied to the putting stroke, this means that the farther back a putter is drawn, when released and allowed to behave like a pendulum under the influence of gravity, the greater the force will be that is applied to the golf ball, and in turn the farther the ball will travel along the putting path 27. As shown in FIG. 1A, one or more force markings 28 can be included to show the expected length the golf will travel when struck, as a function of the length of the backswing. In the example shown, force markings of 6, 10, and 15 ft, provide an estimate of ball travel with backswings as indicated. The precise force markings on the face are for the purposes of illustration only and are not limiting to the scope of the invention. Other markings and other units may be used. In some cases, the force markings may be integer values, such as 1, 2, 3 and so on that do not literally correspond to a distance but rather indicate relative increases in kinetic energy that will be applied to the golf ball when the putter head is released from a specific force marking.

As is known in golf, putting surfaces can vary widely in how far a ball will travel with a given initial velocity. It is common practice to rate the "speed" of a golf green using a device called a stimpmeter. The stimpmeter is a standardized device for rolling a golf ball on a green in order to provide a measurement of how far a ball will roll when started with a standard amount of kinetic energy. Thus, in some embodiments, the force markings on the face of the base could be reference markings of increasing expected kinetic energy being imparted to the golf ball. In some cases, the system may also provide a set of conversion tables to correlate the backswing marking to an expected length the ball will travel, depending on the stimpmeter reading for a green. This would provide even more useful practice in that a user could become proficient at gauging the length of the backswing to produce a putt of a desired length, even as green conditions change from location to location.

To use the training, one will optimally place it on the surface area of a practice putting green or similar surface. To assist in maintaining the device in position while in use, one might secure the training aid to the surface on which is placed with spikes, pins, golf tee or other similar objects inserted through the holes 25 in the training aid and into the underlying surface. In other embodiments, the bottom surface of the training aid might include short spikes that would engage the underlying surface, much like spikes on golf shoes and other similar apparel.

Once place, the user will place a golf ball at the curved region that defines the golf ball placement area 27, normally aligning the center of the golf (which approximates the center of mass) with the visual target reference line 27*a*. It is well known in the art for golfer to draw a line substantially at the equator of a golf ball to aid as an alignment cue when lining up a putt with the intended initial path along which one desires to send the ball in the course of making a putting stroke. Conveniently, a line such as this marked on the ball can be readily aligned with the visual target line reference 27*a* on the top surface 21 of the base 10.

The user will then position the practice tool, in this case a putter 33 with a notch 32 cut into the putter head 31, the notch configured to fit over the guide rail 24 and to allow the putter head to move back and forth along the guide rail. In making a practice stroke the user will then draw the putter back away from the intended target (e.g., a golf hole 110) while maintaining the notch over the guide rail, as depicted in FIG. 4. If the putter follows the optimal path defined by the guide rail, there will be a minimal amount of contact between the guide rail and the notch and the putter head will move relatively freely along the path defined by the guide rail. If the path of the putter head deviates from the path defined by the guide rail, the sides of the notch will tend to rub against the guide rail, creating friction, resistance to movement, which in turn will provide tactile feedback to the user that the putter is not following the optimal path. By practicing, a user will develop muscle memory such that the user will be able to readily move the putter head along the optimal path with minimal resistance. Drawing the putter head away from the target is akin to pulling a pendulum to one side, which by definition results in the storage of kinetic energy in the pendulum.

To complete the putting stroke the user then allows the putter head to "release" that is to allow gravity to move it back to the position at which the putter head has its lowest potential energy, otherwise referred to as the bottom of the putting stroke. The kinetic energy stored in the putter head acting as a pendulum is imparted to the golf ball which then causes the ball to move down the intended initial path towards the target. The distance the ball travels can be varied by how far the putter head is initially drawn back, i.e., how much kinetic energy is loaded in the pendulum. As described above, markings on the top surface give the user visual cues as to the relative distance a putt will travel when using the device as described. By drawing the putter head farther back from the target and releasing, the amount of kinetic energy stored at the top of the stroke will be increased such that when the putter head is released, and the ball is struck, it will travel further before stopping.

It will be apparent to those skilled in the art that many more modifications besides those already described are possible without departing from the inventive concepts herein. For example, it will be realized that the optimal dimensions for the various parts of the invention, materials, shape, form, manner of assembly, and operation or use will be apparent to those of skill in the art. The inventive subject matter, therefore, is not to be restricted except in the scope of any appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. All suitable modifications and equivalents that may be resorted to are thereby considered to be within the scope of the present invention.

The invention claimed is:

1. A training aid for use on a putting surface to assist a user in practicing a putting stroke, the training aid comprising:

a. a base comprising a top surface, bottom surface and edge;

b. a guide rail located on and extending upwards from the top surface of the base and shaped to describe two superimposed arcs defining the complex curvature of a dual axis travel path of a putter head in a putting stroke for the putting of a golf ball along an intended initial path towards an intended target wherein:

i. a first arc is oriented substantially parallel to the putting surface; and ii. a second arc is oriented substantially perpendicular to the putting surface; and c. a practice putter comprising the putter head with a bottom surface, a shaft, and a handle for grasping by a user, wherein the bottom surface of the putter head further comprises a notch shaped and sized to act cooperatively with the guide rail to guide the putter head along the guide rail, wherein the bottom surface of the putter head is substantially planar permitting use of the practice putter on a regular putting surface without the training aid; and wherein the putter head will follow the described optimal path by cooperation of the guide rail and the notch in the course of making a practice putting stroke.

2. The training aid of claim 1, wherein the base further comprises a golf ball placement area placed to accommodate the placement of the center of mass of a golf ball substantially directly over the intended initial path.

3. The training aid of claim 1, wherein the top surface of the base further comprises at least one force marking to visually aid a user in varying the force applied to the golf ball in the course of making the practice putting stroke.

4. The training aid of claim 3, wherein the base further includes a printed conversion table comprising a first axis marked with each of the at least one force markings and a second axis marked with at least one stimpmeter reading for the compaction of a golf green, wherein each meeting point of the two axes in the table indicates an estimated travel distance for a golf ball putted on a green at the indicated stimpmeter reading by a putter stroke when the putter is released from the indicated force marking position.

5. The training aid of claim 1, further comprising a plurality of mounting holes to be used to secure the training aid to the putting surface.

6. A method of assisting a user to practice a putting stroke on a putting surface comprising:

a. providing a training aid comprising:

i. a base comprising a top surface, bottom surface and edge;

ii. a guide rail located on and extending upwards from the top surface of the base and shaped to describe two superimposed arcs defining the complex curvature of a dual axis travel path of a putter head in a putting stroke for the putting of a golf ball along an intended initial path towards an intended target wherein:

1. a first arc is oriented substantially parallel to the putting surface; and 2. a second arc is oriented substantially perpendicular to the putting surface;

iii. a practice putter comprising the putter head with a bottom surface, a shaft, and a handle for grasping by a user, wherein the bottom surface of the putter head further comprises a notch shaped and sized to act cooperatively with the guide rail to guide the putter head along the guide rail, wherein the bottom surface of the putter head is substantially planar permitting use of the practice putter on a regular putting surface without the training aid, and wherein the putter head will follow the described optimal path by cooperation of the guide rail and the notch in the course of making a practice putting stroke;

b. positioning a golf ball at a location on the putting surface substantially in line with the intended initial path;

c. placing the practice putter such that the notch is cooperatively positioned engaging the guide rail;

d. while holding the handle of the practice putter, drawing the practice putter away from the intended target and the golf ball to a point such that a desired amount of kinetic energy is stored in the putter head; and e. completing the practice putting stroke by allowing the practice putter, under the influence of gravity, to swing back towards the golf ball and allowing the putter to strike the golf ball, sending the golf ball along the intended initial path towards the target.

7. The method of claim 6, wherein the base further comprises a golf ball placement area placed to accommodate the placement of the center of mass of a golf ball substantially directly over the intended initial path, and the positioning of the golf ball takes place within the golf ball placement area.

8. The method of claim 6, wherein the top surface of the base further comprises at least one force marking to aid a user in varying the force applied to the golf ball in the course of making the practice putting stroke, and the user refers to the at least one force marking to adjust the distance the golf ball will travel when completing the practice putting stroke.

9. The method of claim 8, wherein the base further includes a printed conversion table comprising a first axis marked with each of the at least one force markings and a second axis marked with at least one stimpmeter reading for the compaction of a golf green, wherein each meeting point of the two axes in the table indicates an estimated travel distance for a golf ball putted on a green at the indicated stimpmeter reading by a putter stroke when the putter is released from the indicated force marking position.

10. The method claim 6, wherein the training aid is secured to the putting surface using anchoring objects inserted through mounting holes in the base.

* * * * *